United States Patent [19]

Culling

[11] 4,278,465

[45] Jul. 14, 1981

[54] CORROSION-RESISTANT ALLOYS

[75] Inventor: John H. Culling, Kirkwood, Mo.

[73] Assignee: Carondelet Foundry Company, St. Louis, Mo.

[21] Appl. No.: 90,572

[22] Filed: Nov. 2, 1979

[51] Int. Cl.[3] ..... C22C 30/02

[52] U.S. Cl. ..... 75/122; 75/134 C

[58] Field of Search ..... 75/122, 134 C, 134 F

[56] References Cited

U.S. PATENT DOCUMENTS

| | | | |
|---|---|---|---|
| 2,570,194 | 10/1951 | Bieber et al. | 148/162 |
| 3,044,871 | 7/1962 | Mott | 75/125 |
| 3,552,950 | 1/1971 | Rundell et al. | 75/122 |
| 3,758,296 | 9/1973 | Johnson | 75/122 |
| 3,759,704 | 9/1973 | Culling | 75/122 |
| 3,947,266 | 3/1976 | Culling | 75/122 |
| 4,135,919 | 1/1979 | Culling | 75/134 C |

*Primary Examiner*—R. Dean

*Attorney, Agent, or Firm*—Senniger, Powers, Leavitt and Roedel

[57] ABSTRACT

An air meltable, workable, weldable castable alloy resistant to sulfuric acid solutions and heat treatable to impart hardness and resistance to abrasion and erosion. The alloy consists essentially of between about 25.00 and about 28.00% by weight nickel, between about 35.00 and about 38.00% by weight chromium, between about 1.50 and about 3.0% by weight molybdenum, between about 2.8 and about 3.8% by weight copper, between about 3.0 and about 4.5% by weight manganese, between about 0.25 and about 0.85% by weight niobium, between about 20.0 and about 34.2% by weight iron, up to about 1% by weight titanium, up to about 1% by weight tantalum, up to about 0.010% by weight boron, up to about 0.5% by weight cobalt, up to about 1.0% by weight silicon, up to about 0.08% by weight carbon, up to about 0.6% by weight of a rare earth component that may be either cerium, lanthanum or misch metal, and up to about 0.15% by weight nitrogen.

3 Claims, No Drawings

CORROSION-RESISTANT ALLOYS

BACKGROUND OF THE INVENTION

This invention relates to the field of corrosion-resistant alloys and more particularly to low strategic metal content, machinable, non-brittle alloys resistant to sulfuric acid solutions and to abrasion or erosion.

For purposes of analyzing and predicting their corrosive effect on various metals, acids and other corrosive agents are commonly classified as either "oxidizing" or "reducing". A reducing medium is generally defined as one which includes no component more oxidizing than the hydrogen ion or hydronium ion while an oxidizing medium is one which does contain such a component. Common mineral acids such as hydrochloric acid, acetic acid, phosphoric acid, aluminum chloride, hydrobromic acid and hydrofluoric acid are normally reducing media. Solutions of sulfuric acid and water at acid strengths less than about 60% by weight are normally reducing at temperatures below about 20° C. However, at temperatures in the range of 150° F. or above, a 60% by weight sulfuric acid solution becomes oxidizing. Moreover, various industrial sulfuric acid streams are rendered oxidizing by the presence of additives or components that are oxidizing in character. Among the common oxidizing agents are nitric acid, which is present in the "mixed acids" used in organic nitration processes, hydrogen peroxide, ferric sulfate, silver nitrate, potassium nitrate, sodium nitrate, copper sulfate, potassium permangenate, sodium dichromate, chromic acid, calcium chloride, mercuric chloride, sodium hypochlorite, ferric chloride, and cupric chloride.

Industrial sulfuric acid streams also frequently contain solid or gritty substances of various particles sizes and shapes, as well as bubbles of entrained gas. Otherwise corrosion-resistant alloys exposed to moving streams of acid containing solid components often tend to wear or abrade and the presence of bubbles of air or other gas can accelerate erosive attack of the metal surface. While the mechanisms of erosion are not fully understood, the structural damage to metals and alloys is similar to abrasive wear in that metallic material is removed from the surfaces of equipment, piping and other components exposed to streams containing bubbles of gas.

It is recognized in the art that the resistance of an alloy to abrasion or erosion can be improved by increasing the hardness of the alloy. One technique which has frequently been employed to improve the hardness of stainless steel is precipitation-hardening. In accordance with these technique, alloys of chromium, nickel, iron, and various additional elements are initially cast or wrought in soft ductile form, and hardened after fabrication by heating to a prescribed temperature so as to precipitate microscopic particles of intermetallic compounds within the body of the alloy. In the heat treating process, some of these alloys may undergo phase transformation from soft ductile austenite to harder matrix phases such as martensite.

Precipitation-hardened stainless steels are generally similar to standard stainless steels in their corrosion resistance to sulfuric acid. Thus, such alloys either do not resist sulfuric acid solutions well or resist only very dilute or very concentrated solutions near or below about 20° C.

In order to meet the dual requirements of high hardness and effective resistance to corrosion, a number of alloys have been produced which contain high proportions of molybdenum and other strategic metals. Illustrative of such alloys are those described in Parr U.S. patent 1,115,239, Johnson U.S. Pat. No. 2,938,786, Boyd U.S. Pat. No. 2,938,787, Johnson U.S. Pat. No. 3,758,296, and Culling U.S. Pat. No. 3,759,704. The alloys of these various references are advantageous in certain respects but each presents the relative disadvantage of rather high strategic metal requirements.

High hardness is achieved in a variety of alloys by the incorporation of silicon. Both iron-base and nickel-base alloys of this type have been developed, and certain of these have been resistant to corrosion by sulfuric acid streams as well as to abrasion and erosion. Additionally, the iron-base variations are of low strategic metal content. However, all of these alloys exhibit a high degree of brittleness, with the iron-base alloys being more brittle than the nickel-base variations and, in fact, often more brittle than window glass. Neither type of silicon-base alloy is machinable in the usual sense. In certain of these alloys, such as Johnson U.S. Pat. No. 2,938,786, Boyd U.S. Pat. No. 2,938,787 and Johnson U.S. Pat. No. 3,758,296, boron is included for the purpose of offsetting the embrittling effect of silicon, but even the alloys of this latter type are very brittle and difficult to machine.

Mott U.S. Pat. No. 3,044,871 discloses hardenable corrosion-resistant stainless steels containing chromium, silicon and molybdenum in certain specified combination of proportions. However, Mott requires either rather high silicon content, high molybdenum content, or both, and the alloys disclosed in this reference are not generally subject to softening for purposes of machining or fabricating prior to surface hardening.

Generally, therefore, the art has known precipitation-hardening stainless steels that can be made available in a relatively soft condition for fabrication and machining, followed by hardening for service, but these are not very resistant to sulfuric acid in the highly corrosive medium range of concentrations nor to sulfuric acid containing oxidizing components. On the other hand, castable alloys have been available which exhibit corrosion resistance superior to that of the precipitation-hardening steels but such castable alloys have generally contained relatively high proportions of silicon and are notable for brittleness, low machinability and liability to thermal and mechanical cracking.

SUMMARY OF THE INVENTION

Among the several objects of the present invention, therefore, may be noted the provision of improved alloys suitable for use in sulfuric acid service; the provision of such alloys which are resistant to sulfuric acid over a wide range of concentrations, including the relatively corrosive concentrations between 20% and 60%; the provision of such alloys which are resistant to oxidizing sulfuric acid solutions in such concentration range; the provision of such alloys which can be provided in a relatively soft condition adapted for fabrication and machining; the provision of such alloys which are weldable; the provision of such alloys which are castable without cracking; and the provision of such alloys which can be hardened by heat treatment to resist abrasion and erosion in the many dilute to intermediate strength industrial sulfuric acid streams that may contain oxidants or other contaminants, together with suspended solids or entrained gas.

Briefly, the present invention is directed to an air meltable, workable, weldable, castable alloy, resistant to sulfuric acid solutions, that may be heat treated to harden it and render it resistant to abrasion and erosion. The alloy consist essentially of between about 25.00 and about 28.00% by weight nickel, between about 35.00 and about 38.00% by weight chromium, between about 1.50 and about 3.0% by weight molybdenum, between about 2.8 and about 3.8% by weight copper, between about 3.0 and about 4.5% by weight manganese, between about 0.25 and about 0.85% by weight niobium, between about 20.0 and about 34.2% by weight iron, up to about 1% by weight titanium, up to about 1% by weight tantalum, up to about 0.010% by weight boron, up to about 0.5% by weight cobalt, up to about 1.0% by weight silicon, up to about 0.08% by weight carbon, up to about 0.6% by weight of a rare earth component selected from the group consisting of cerium, lanthanum and misch metal, and up to about 0.15% by weight nitrogen.

Other objects and features will be in part apparent and in part pointed out hereinafter.

DESCRIPTION OF THE PREFERRED EMBODIMENT

In accordance with the present invention, alloys are provided in which the proportions of strategic metals are generally lower than those of commercially available cast hard sulfuric acid resistant alloys other than the very brittle iron-silicon base alloys. However, despite their relatively low strategic metal content, the alloys of this invention are highly resistant to corrosion by sulfuric acid solutions up to a concentration of about 60%, and retain such corrosion resistance even at elevated temperatures and in the presence of oxidizing agents such as nitric acid. The alloys of the invention are relatively soft as cast, but may be hardened after machining, welding or other fabrication to exhibit high hardness levels for increased resistance to abrasion and erosion, but without becoming extremely brittle.

The essential components of the alloys of the invention are:

| | |
|---|---|
| Nickel | 25.00–28.00% |
| Chromium | 35.00–38.00% |
| Molybdenum | 1.50–3.0% |
| Copper | 2.8–3.8% |
| Manganese | 3.0–4.5% |
| Niobium | 0.15–0.85% |
| Iron | 20.0–34.2% |

Normally the alloys of the invention also contain carbon up to a maximum of about 0.08% by weight, and they optionally further contain:

| | |
|---|---|
| Titanium | up to 1% |
| Tantalum | up to 1% |
| Boron | up to p.010% |
| Cobalt | up to 0.5% |
| Silicon | up to 1.0% |
| Cerium, Lanthanum, or Misch Metal | up to 0.6% |
| Nitrogen | up to 0.15% |

As a result of the unique combination of proportions of component metals as specified above, the alloys of the invention are ductile and fabricable in the cast condition, but can be heat hardened to a degree of hardness that is highly resistant to erosion and abrasion. Thus, the alloys can be cast into a variety of shapes such as bars, cylinders and rings without experiencing cracks or other significant defects in the castings, and the casts shapes may be subjected to all of the common machining operations such as drilling, tapping, milling, turning and grinding. In such operations cemented carbide, ceramic or high speed tool materials are best, as they are for stainless steel and similar alloys in general. Using such a suitable tool, no cracking or other particular difficulties are encountered in machining.

As-cast hardness of the alloys of the invention typically range from 170 to 187 BNH. Increased hardness is achieved by heat treatment, with the maximum hardness achieved at a temperature of approximately 1750° F. Set forth in Table 1 are the approximate Brinell hardness numbers achieved by heat treatment to various temperatures.

TABLE 1

| Heat Treating Temperature | Brinell Hardness Number |
|---|---|
| As-Cast | 170–187 |
| 1200° to 1400° F. | 197–207 |
| 1550° F. | 225–240 |
| 1600° F. | 240–255 |
| 1700° F. | 275–285 |
| 1750° F. | 295–305 |
| 1800° F. | 275–285 |

Although I do not wish to be held to a particular theory, it is believed that the combinations of component metals as specified hereinabove provide a uniquely advantageous balance between austenitizing and ferritizing elements to provide an overall alloy structure which combines the desirable properties of machinability and workability in the as-cast condition with susceptibility to hardening thereafter by appropriate heat treatment.

Among the various component metals of the alloys, chromium is known to afford iron-based alloys with resistance to oxidizing media. Although stainless steels and nickel alloys frequently contain 15 to 28% chromium, the relatively high chromium level of the alloys of the invention contributes to hardenability and further enhances corrosion resistance in the presence of abrasive and erosive factors.

Nickel is a basic component of sulfuric acid resistant alloys and is an important component in maintaining the balance between austenitizing and ferritizing elements so that hardenability can be controlled.

Manganese is an austenitizing component whose presence is of particular importance in view of the relatively low nickel to chromium ratio of the alloys of the invention. Copper is another austenitizing component which is also generally efficacious in contributing to sulfuric acid resistance. It has been found that alloys having the relatively low nickel and high chromium contents described above possess optimum properties where copper is present in a range of 2.8 to 3.8% by weight and manganese in a proportion of 3.0 to 4.5% by weight.

In contrast with many of the sulfuric acid-resistant alloys available in the art, the molybdenum content of the alloys of the invention is relatively small. However, a proportion in the defined range of 1.50 to 3.0% by weight has been found to be important, not only from the standpoint of corrosion resistance as such, but also because of the effect of the molybdenum crystalline structure as a strong ferritizer. As noted, a careful balance between austeritizing and ferritizing elements is maintained in the alloys of the invention, with nickel, manganese, carbon, nitrogen, cobalt and copper as austenitizing components and chromium, molybdenum, niobium, titanium, tantalum, boron, silicon and rare earth components as ferritizing components.

Niobium, tantalum and titanium are recognized as carbide stabilizers which prevent the intergranular corrosion that is characteristic of numerous corrosive solutions. In this regard, niobium is preferred over tantalum and titanium. Thus, tantalum is more expensive than niobium but only half as effective as the latter in carbide stabilization. Normally, therefore, tantalum is included only as an impurity in niobium ores but may also be used as a substitute when niobium is in short supply. Although titanium is a lower cost carbide stabilizer at the prices normally prevailing in the United States, the titanium content is rather more difficult to maintain in an air melting process due to its high affinity for oxygen in the air. It may even tend to burn out of the melted metal in air melting. For all these reasons, niobium is a preferred and essential component of the alloys of the invention. Additionally, it has been found that niobium enhances corrosion resistance of the alloys of the invention even when carbon is almost eliminated or otherwise stabilized.

Titanium, niobium, carbon, nitrogen, boron and rare earth elements, when present in relatively small amounts, are effective to enhance toughness and workability in alloys of the type described herein. However, when present in large amounts, each of these elements ultimately has the opposite effect, i.e., embrittling and damaging workability, weldability, and machinability. Within the limits specified above, the effect of titanium, boron and rare earth components is beneficial for workability, and they may optionally be included. Nitrogen is typically present as an impurity in a proportion within the limit specified as a result of melting the alloys in air.

Carbon is normally present in the raw materials used for preparing alloys of the type herein described. Although detrimental if present in excessive amounts, carbon can be tolerated in a proportion up to about 0.08% by weight. As noted, niobium, titanium, and/or tantalum are included in proportions sufficient for carbide stabilization. Niobium is an essential component in a proportion of at least 0.25% by weight and no additional amount of carbide stabilizer is necessary if the carbon content does not exceed about 0.03% by weight. Where carbon is present in a proportion of between about 0.03 and about 0.08%, it may be stabilized by inclusion of eight times its weight of niobium, 16 times its weight of tantalum or five times its weight of titanium. Thus the proportions of carbon and these three components should satisfy the following relationship:

$$8Nb+16Ta+5Ti \geqq C \qquad \text{(Eq.1)}$$

Slightly higher levels of stabilizers are desirable under extremely corrosive conditions or where the alloys are subjected to unusually sensitizing heat conditions prior to exposure. However, under such circumstances a portion of the burden of carbide stabilization is typically assumed by concomitantly higher nitrogen levels within the range specified above. In general, if the carbon content of the alloy is at the maximum allowable level of 0.08% by weight, a niobium content of about 0.64% is adequate.

Cobalt is typically present as an impurity in nickel sources. Accordingly the alloys of the invention allow for a cobalt content of up to about 0.5% by weight. Higher levels should be avoided so as not to interfere with hardenability factors.

Silicon is held to a maximum of about 1.0% in the alloys of the invention. Silicon is an extremely strong ferritizer and, in the presence of the relatively high chromium levels of the alloys, must be controlled below the above noted maximum in order to avoid the extreme brittleness associated with high silicon alloys of the the prior art.

An important feature of the present invention is the discovery that effective corrosion resistance, together with resistance to abrasion and erosion, can be achieved by a careful balance of surprisingly low proportions of strategic metal. By virtue of this discovery, the iron content of the alloys can be maintained in the relatively high range of 20 to 34.2% by weight. As a result, the alloys may be formulated from low cost raw materials such of scrap, ferro alloys or other commercial melting alloys. Conventional methods of melting are employed and no special conditions such as controlled atmosphere, special furnace linings, or special molding materials are required.

As noted, the alloys of the invention are uniquely balanced between austenitizing and ferritizing components. The presence of ferrite in the alloys contributes to their tensile and yield strength, and a proper balance between austenite and ferrite imparts high strength without significant adverse impact on toughness or ductility.

For Ni/Cr alloys of up to about 38% by weight chromium, it has been found that the boundary between all austenitic materials and those containing significant amounts of ferrite is defined by the relationship:

$$100[Ni]=(100[Cr]-18)^2/12+8, \qquad \text{(Eq. 2)}$$

or $$100[Cr]=\sqrt{12(100[Ni]-8)+18} \qquad \text{(Eq. 3)}$$

where [Ni] = the weight fraction of nickel and [Cr] = the weight fraction of chromium in the alloy. For alloys containing appreciable amounts of C, Mn, N, Si, Mo, Ta, and/or Mo, the above relationships hold with respect to nickel equivalencies ([Ni]eq.) and chromium equivalences ([Cr]eq.), i.e.

$$100[Cr]eq.=\sqrt{12(100[Ni]eq.-8)+18} \qquad \text{(Eq.4)}$$

where $$100[Ni]eq.=100[Ni]+20(100[C]-0.05)+0.5(100[Mn]-0.5)+20(100[N]-0.02)+30[Cu]; \qquad \text{(Eq. 5)}$$

$$100[Cr]eq.=100[Cr]+2.5(100[Si]-0.3)+180[Mo]+120[Ta]+240[Nb] \qquad \text{(Eq. 6)}$$

and where

[Cr] = weight fraction chromium
[Ni] = weight fraction nickel
[C] = weight fraction carbon
[Cu] = weight fraction copper
[Mn] = weight fraction manganese

[N]=weight fraction nitrogen
[Mo]=weight fraction molybdenum
[Ta]=weight fraction tantalum
[Nb]=weight fraction niobium In accordance with the invention, I have discovered that the most favorable properties are obtained when the [Cr]eq. exceeds by between about 0.06 or 0.08 the [Cr]eq. required for austenite/ferrite balance as defined by the relationship of equation (4), i.e.,:

$$24 \leqq 100[\text{Cr}]\text{eq.} - \sqrt{12(100[\text{Ni}]\text{eq.} - 8)} \leqq 26 \qquad \text{(Eq.7)}$$

Because of the slow phase transformation exhibited by Ni/Cr alloys containing significant proportions of Cr, alloys satisfying the relationship of equation (7) have about 12% by volume ferrite in the as-cast condition. However, the ferrite content of such alloys can be increased to 40–50% by matrix volume when heat treated in the 1700°–1800° F. range.

The following examples illustrate the invention:

EXAMPLE 1

In accordance with the invention, 100 lb. heats of several different alloys were prepared by melting in a 100 lb. high frequency induction furnace. Compositions of these alloys are set forth in Table 2. After casting, alloy 1241 was subjected to Grinell hardness testing and exhibited a BHN in the range of 170–187. Subsequently samples of alloy 1241 were heated at various temperatures ranging from 1200°–1400° F. to 1800° F. and the effect on hardness determined for heating at each such temperature. The Grinell hardness test results fell within the ranges listed in Table 1 hereinabove.

TABLE 2

| Alloy Composition - Alloys of the Invention Percent by Weight of Alloying Elements | | | | | | | | |
|---|---|---|---|---|---|---|---|---|
| Alloy Number | Ni | Cr | Mo | Cu | Mn | Nb | C | Si |
| 1241 | 26.52 | 36.56 | 1.95 | 2.95 | 3.13 | 0.41 | 0.40 | 0.40 |
| 1276 | 25.23 | 35.82 | 1.73 | 3.71 | 3.45 | 0.33 | 0.05 | 0.68 |
| 1277 | 27.66 | 27.81 | 2.82 | 2.97 | 4.21 | 0.71 | 0.07 | 0.11 |

Alloy 1241, whose a composition falls approximately in the middle of the ranges defined by the alloys of the invention, was subjected to physical testing. A standard physical test block was subjected to a tensile test prior to heat treatment and determined to have a tensile strength of 78,100 psi, a yield strength of 43,400 psi and an elongation of 25.5%. Hardness of this test block was measured at 179 BHN. Another test block prepared from alloy 1241 was heat treated for four hours at 1600° F. and then slowly cooled. In a tensile test this block exhibited a tensile strength of 98,700 psi, a yield strength of 50,400 psi and an elongation at 10.5%. Its hardness was measured at 255 BHN.

EXAMPLE 2

Corrosion tests were carried out for each of alloys 1241, 1276 and 1277 in several different convafractions of sulfuric acid.

Corrosion test bars taken from each alloy were heat treated for four hours at 1600° F. and cooled in the same fashion as for the physical test block of Example 1. The test bars were then machined into ½" diameter by 4" high disks having a ⅛" diameter hole in the center. Twelve to 14 disks were obtained from each bar. Residual machining oil and dirt were removed from all the sample disks by cleaning with a small amount of carbon tetrachloride. The disks were then rinsed in water and dried. Each disk was weighed to the nearest 1000th of a gram and then suspended in a beaker by a piece of thin platinum wire hooked through the center hole of the disk and attached to a glass rod which rested on top of the beaker. The solution in which corrosion was to be determined was then added to the beaker so that the entire sample was surrounded. Temperature of the bath was thermostatically controlled during the corrosion test by means of a water bath and each beaker was covered with a watch glass to minimize evaporation.

Corrosion tests were run in 10%, 25%, 40%, 50% and 60% by weight sulfuric acid at 80° C. After precisely 6 hours of exposure at such temperature the sample disks were removed from the sulfuric acid solution and cleaned of corrosion products. Most samples were cleaned sufficiently with a small nylon bristle brush and tap water. After any corrosion products had been removed, each disk was again weighted to the nearest 1000th of a gram. The corrosion rate of each disk in inches per year was calculated by the following formula in accordance with ASTM specification Gl-67

$$R_{ipy} = 0.3937(Wo\text{-}Wf/ADT)$$

$R_{ipy}$=corrosion rate in inches per year
$W_o$=original weight of sample
$W_f$=final weight of sample
A=area of sample in $cm^2$
T=duration of test in years
D=density of alloy in g/cc No measurable corrosion was found in any of the corrosion test of this example.

EXAMPLE 3

Because oxidizing contaminants are often present in commercial sulfuric acid streams, samples of the alloys of the invention were tested for corrosion resistance in such environments. Utilizing the test method described in Example 2, corrosion tests were conducted in 10%, 25%, 40%, 50% and 60% sulfuric acid solutions each containing 5% by weight nitric acid at 80° C. Results of these tests are set forth in Table 3.

TABLE 3

| Corrosion Rates in Inches Per Year (I.P.Y.) Penetration at 80° C. for various sulfuric acid-water solutions containing 5% nitric acid | | | | | |
|---|---|---|---|---|---|
| | Sulfuric Acid Strength (% by weight $H_2SO_4$) | | | | |
| Alloy Number | 10% | 25% | 40% | 50% | 60% |
| 1241 | 0.0022 | 0.0024 | 0.0027 | 0.0032 | 0.0051 |
| 1276 | 0.0021 | 0.0014 | 0.0016 | nil | 0.0044 |
| 1277 | 0.0018 | 0.0016 | nil | nil | 0.0046 |

EXAMPLE 4

Because commercial sulfuric acid streams containing oxidants are commonly handled at high temperatures in relatively dilute ranges, such as in pickling tanks, corrosion tests were conducted in boiling 10%, 25%, and 40% sulfuric acid water solutions containing 5% nitric acid. The test samples were prepared and the corrosion tests carried out in the manner described in Example 2. Results of these tests are set forth in Table 4.

TABLE 4

Corrosion Rates in Inches Per Year (I.P.Y.) Penetration for Various Boiling Solutions of Sulfuric Acid and Water Plus 5% Nitric Acid

| Alloy Number | Sulfuric Acid Strength (% by weight) 10% | 25% | 40% |
|---|---|---|---|
| 1241 | 0.0076 | 0.0086 | 0.0189 |
| 1276 | 0.0065 | 0.0093 | 0.0169 |
| 1277 | 0.0065 | 0.0088 | 0.0178 |

EXAMPLE 5

Although dilute sulfuric acid solutions such as those used in many pickling operations pick up oxidizing salts and contaminants to become oxidizing after some period of operations, these compositions are relatively pure acid-water solutions of a rather strongly reducing character under start-up conditions. In order to test the resistance of the high chromium alloys of the invention to such reducing acids, alloy 1241 was subjected to corrosion testing in boiling 10% sulfuric acid. The test was carried out in the manner described in Example 2 and the corrosion rate was determined to be 0.0172 I.P.Y.

From the test results described above, the corrosion resistance of the alloys of the invention has been demonstrated to equal or exceed that of commercially available alloys in solutions of the type to be encountered in applications for which these alloys are intended.

In view of the above, it will be seen that the several objects of the invention are achieved and other advantageous results attained.

As various changes could be made in the above products without departing from the scope of the invention, it is intended that all matter contained in the above description shall be interpreted as illustrative and not in a limiting sense.

What is claimed is:

1. An air meltable, workable, weldable, castable alloy resistant to sulfuric acid solution and hardenable by heat treatment to impart hardness and resistance to abrasion and erosion, said alloy consisting essentially of between about 25.00 and about 28.00% by weight nickel, between about 35.00 and about 38.00% by weight chromium, between about 1.50 and about 3.0% by weight molybdenum, between about 2.8 and about 3.8% by weight copper, between about 3.0 and about 4.5% by weight manganese, between about 0.25 and about 0.85% by weight niobium, between about 20.0 and about 34.2% by weight iron, up to about 1% by weight titanium, up to about 1% by weight tantalum, up to about 0.010% by weight boron, up to about 0.5% by weight cobalt, up to about 1.0% by weight silicon, up to about 0.08% by weight carbon, up to about 0.6% by weight of a rare earth component selected from the group consisting of cerium, lanthanum and misch metal, and up to about 0.15% by weight nitrogen.

2. An alloy as set forth in claim 1 wherein the weight fractions of components satisfy the relationship $$24 \leqq 100[Cr]eq. - \sqrt{12(100[Ni]eq. - 8)} \leqq 26$$

where $$100[Ni]eq. = 100[Ni] + 20(100[C] - 0.05) + 0.5(100[Mn] - 0.5) + 20(100[N] - 0.02) + 30[Cu]; \quad \text{(Eq. 5);}$$

$$100[8\ Cr]eq. = 100[Cr] + 2.5(100[Si] - 0.3) + 180\ [Mo] + 120\ [Ta] + 240\ [Nb] \quad \text{(Eq. 6);}$$

and where

[Cr]=weight fraction chromium
[Ni]=weight fraction nickel
[C]=weight fraction carbon
[Cu]=weight fraction copper
[Mn]=weight fraction manganese
[N]=weight fraction nitrogen
[Mo]=weight fraction molybdenum
[Ta]=weight fraction tantalum
[Nb]=weight fraction niobium.

3. An alloy as set forth in claim 1 wherein the carbon content, niobium content, tantalum content and titanium content satisfy the relationship $$8[Nb] + 16[Ta] + 5[Ti] \geqq [C]$$

where

[Nb]=weight fraction niobium
[Ta]=weight fraction tantalum
[Ti]=weight fraction titanium
[C]=weight fraction carbon.

* * * * *

UNITED STATES PATENT AND TRADEMARK OFFICE

CERTIFICATE OF CORRECTION

PATENT NO. : 4,278,465

DATED : July 14, 1981

INVENTOR(S) : John H. Culling

It is certified that error appears in the above—identified patent and that said Letters Patent is hereby corrected as shown below:

Column 6, line 38, "100[Ni]=(100[Cr]-18)$^2$/12+8" should read --100[Ni] = $\frac{(100[Cr] - 18)^2}{12}$ + 8--. Column 6, line 42, "100[Cr]= $\sqrt{12(100[Ni]-8)+18}$" should read --100[Cr] = $\sqrt{12(100[Ni]-8}$ + 18--. Column 10, line 22, "100[8Cr]eq." should read --100[Cr]eq.--.

Signed and Sealed this

*Thirteenth* Day of *October 1981*

[SEAL]

*Attest:*

GERALD J. MOSSINGHOFF

*Attesting Officer*

*Commissioner of Patents and Trademarks*